US008681065B2

(12) United States Patent
Vion et al.

(10) Patent No.: US 8,681,065 B2
(45) Date of Patent: Mar. 25, 2014

(54) PARABOLIC ANTENNA POSITIONER

(75) Inventors: Benoit Vion, Colombes (FR); Sandrine Jourda, Colombes (FR); Christophe Laffont, Colombes (FR); Gilles Quagliaro, Colombes (FR)

(73) Assignee: Thales, Neuilly sur Seine (FR)

( * ) Notice: Subject to any disclaimer, the term of this patent is extended or adjusted under 35 U.S.C. 154(b) by 364 days.

(21) Appl. No.: 13/280,559

(22) Filed: Oct. 25, 2011

(65) Prior Publication Data

US 2012/0098727 A1 Apr. 26, 2012

(30) Foreign Application Priority Data

Oct. 26, 2010 (FR) ..... 10 04199

(51) Int. Cl.
*H01Q 3/00* (2006.01)

(52) U.S. Cl.
USPC ..... 343/765; 343/766; 343/882

(58) Field of Classification Search
USPC ..... 343/840, 878, 882, 765, 766; 248/128
See application file for complete search history.

(56) References Cited

U.S. PATENT DOCUMENTS

| | | | | |
|---|---|---|---|---|
| 4,282,529 | A | 8/1981 | Speicher | |
| 5,227,806 | A * | 7/1993 | Eguchi | 343/765 |
| 6,285,338 | B1 | 9/2001 | Bai et al. | |
| 6,333,718 | B1 * | 12/2001 | Poncel et al. | 343/753 |
| 6,911,950 | B2 * | 6/2005 | Harron | 343/766 |
| 7,463,206 | B1 * | 12/2008 | Kyhle | 343/766 |
| 8,120,541 | B2 * | 2/2012 | Jung et al. | 343/766 |
| 2002/0030631 | A1 | 3/2002 | Verkerk | |
| 2003/0141420 | A1 | 7/2003 | Knight | |
| 2007/0241244 | A1 | 10/2007 | Tavassoli Hozouri | |

FOREIGN PATENT DOCUMENTS

| | | | |
|---|---|---|---|
| CA | 1236211 | A1 | 5/1988 |
| FR | 2589633 | A1 | 5/1987 |
| GB | 735359 | | 8/1955 |
| WO | 98/57389 | A1 | 12/1998 |
| WO | 2009/033085 | A1 | 3/2009 |

* cited by examiner

*Primary Examiner* — Tan Ho

(74) *Attorney, Agent, or Firm* — McDermott Will & Emery LLP

(57) ABSTRACT

The parabolic antenna positioner includes a base, a support cradle mounted so it can rotate relative to the base along a first axis of rotation, a mobile assembly including a parabolic antenna, supported by the support cradle, and mounted so it can rotate relative to the support cradle along a second axis of rotation, orthogonal to the first axis of rotation. The second axis of rotation is separated from the axis of rotation of the support cradle by a non-null distance measured in the plane of rotation of the cradle.

9 Claims, 6 Drawing Sheets

PARABOLIC ANTENNA POSITIONER

CROSS REFERENCE TO RELATED APPLICATIONS

The present application claims priority under 35 U.S.C. §119 to French Patent Application No. 10 04199, filed Oct. 26, 2010, which is incorporated herein by reference.

BACKGROUND

The invention relates to the field of satellite communications, more generally known as SATCOM. It more particularly relates to a parabolic antenna positioner to allow communication with a satellite, said positioner in particular being intended to be placed on a moving carrier.

Different types of parabolic antenna positioners currently exist to make it possible to establish a communication with a satellite, these positioners either being stationary relative to the ground, or mobile when they are placed on moving carriers.

Application WO 2009/033085 and U.S. Pat. No. 6,285,338 for example describe positioners of the Elevation over Azimuth type. These positioners include two axes of rotation, one making it possible to vary the azimuth of the parabolic antenna, i.e. the horizontal angle between the direction of the parabolic antenna and a reference direction generally corresponding to geographical north, and the other making it possible to vary the elevation of the parabolic antenna, the vertical angle between the direction of the parabolic antenna and the reference direction (geographical north). Such positioners do, however, have the drawback of having a singular point (better known under the name "keyhole") at the vertical, i.e. the zenith. The notion of keyhole, well known by those skilled in the art, designates a point where the communication between the satellite and the parabolic antenna is difficult, or even impossible, due to the dynamic positioning constraints of the parabolic antenna in the direction of the keyhole. In the particular case of an Elevation over Azimuth positioner, the Azimuth rotation of the parabolic antenna reaches very significant, even infinite, speeds of rotation, upon passage near the keyhole at the vertical with the result that the antenna finds it very difficult to align itself with a satellite situated at the vertical. This communication difficulty is problematic if the positioner is on a moving carrier due to the dynamics that the movement of the carrier gives to the parabolic antenna. Consequently, it is difficult to use such positioners in land areas where the satellites are situated at the vertical of the parabolic antennas, in particular in the equatorial areas.

Applications US 2002/0030631, GB 735 359 and US 2003/0141420 describe XY-type positioners, allowing the parabolic antenna to rotate along two perpendicular horizontal axes X and Y, and for which no keyhole appears at the vertical. These known XY-type positioners do, however, have the drawback of not being balanced or of only being able to be balanced by adding a counterweight, which significantly increases the total mass of the positioners. In fact, to be balanced, an XY-type positioner must be such that the center of gravity of its load, in particular the parabolic antenna, is situated on the axes of rotation X and Y of the load. However, the weight of the load is generally distributed more on one axis than the other and counterweights must therefore be added to offset the imbalance. Such weight overload and imbalance characteristics are not acceptable for a parabolic antenna positioner intended to be placed on a moving carrier, because they damage the dynamic performance of the positioner, and oppose the lightness requirements necessary in certain applications, such as in the aeronautics field.

Lastly, application CA 1 236 211 describes another type of parabolic antenna positioner including three axes of rotation to make it possible to orient, the parabolic antenna in all possible directions toward the satellite. Such a positioner does not have any keyhole, but is very complex to make, very bulky and very expensive.

SUMMARY

In this context, the invention is aimed at proposing a parabolic antenna positioner provided without any keyhole at the vertical and that is balanced, without requiring the addition of counterweights on the positioner, in particular to be able to be placed on a moving carrier.

To that end, the invention relates, according to a first aspect, to a parabolic antenna positioner including a base, a support cradle being mounted so it can rotate relative to the base along a first axis of rotation, a mobile assembly including a parabolic antenna, supported by the support cradle, and mounted so it can rotate relative to the support cradle along a second axis of rotation, orthogonal to the first axis of rotation, and wherein the second axis of rotation is separated from the axis of rotation of the support cradle by a non-null distance measured in the plane of rotation of the cradle.

The positioner can also have one or more of the following features, considered individually or according to all technically possible combinations the distance is such that the center of gravity of the support cradle and the mobile assembly is situated on the first axis of rotation; the distance separating the second axis and the first axis of rotation from the support cradle is comprised between 5 and 15 cm; the support cradle includes a guide crown having a first portion extending along a half-circle axis and two second portions respectively extending from each of the ends of the first portion of the guide crown, perpendicular to the third axis, the mobile assembly being articulated on the two second portions the guide crown, in particular the first portion of the guide crown, includes a guide rail, in particular two guide rails respectively arranged on each of the two longitudinal edges of one surface of the guide crown; the base includes a skate in which the guide rail slides, in particular two skates in which the two guide rails of the guide crown slide, respectively. The guide crown, in particular the first portion of the guide crown, includes a toothed crown extending longitudinally on one surface of the guide crown, in particular from one end of the motor rotating the pinion, and the pinion being able to rotate the guide crown by acting on the toothed first portion toward the other end and the base includes an electric motor and a pinion, the electric crown and the support cradle includes a graduated measuring strip extending longitudinally on one surface of the cradle, it includes an optical reading device, placed in particular on the base, in order to determine the angular position of the guide cradle by optical reading of the graduated measuring strip.

The mobile assembly includes, aside from the parabolic antenna, a radiofrequency amplifier, the parabolic antenna and the radiofrequency amplifier being arranged on either side of the second axis of rotation;

the support cradle is essentially without balance weights.

BRIEF DESCRIPTION OF THE DRAWINGS

Other features and advantages of the invention will emerge from the description of the following embodiments according to the invention provided below, for information and in no way limiting, in reference to the figures of the appended drawing, in which.

DETAILED DESCRIPTION OF THE PREFERRED EMBODIMENTS

Figure 1:
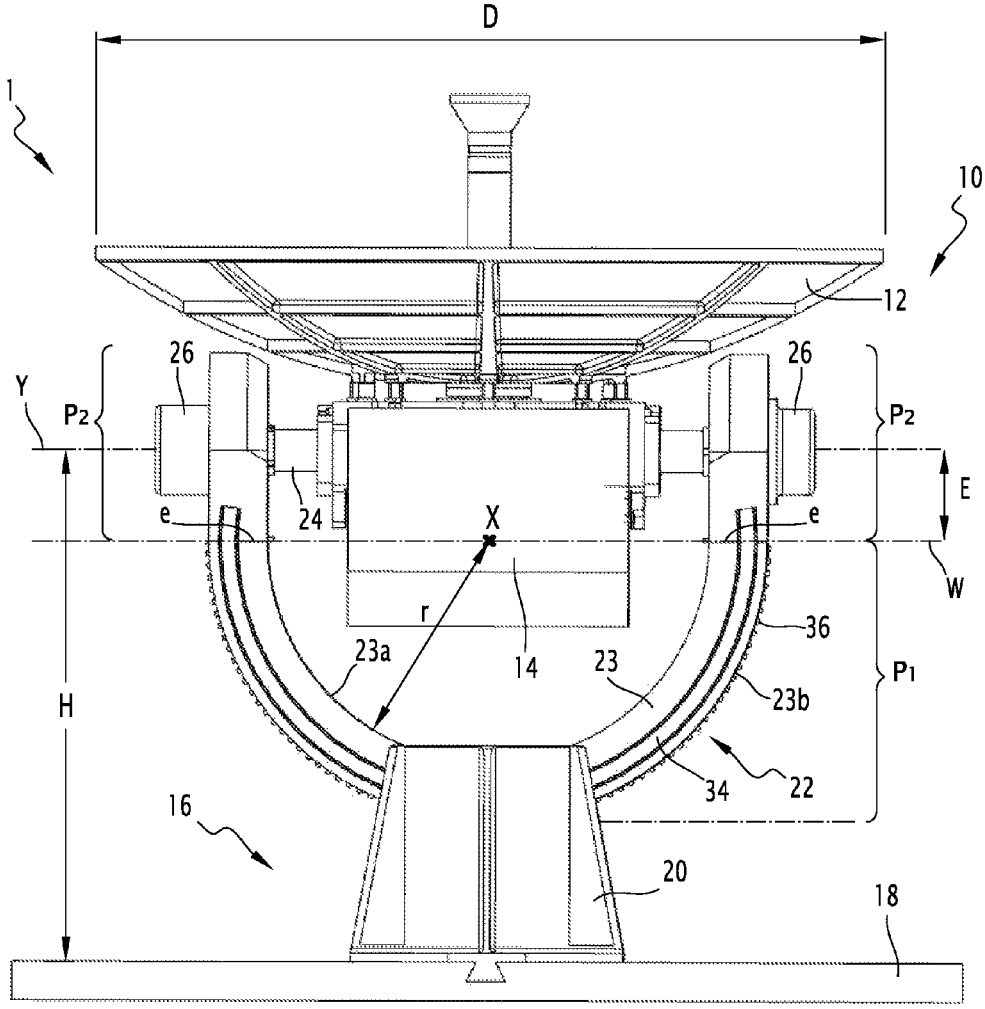
FIG. 1 is an elevation view of a positioner according to the invention equipped with a parabolic antenna and a radiofrequency amplifier.

FIG. 1 shows a perspective view of an example of a positioner 1 according to the invention, equipped with a moving assembly 10 with two degrees of freedom comprising a parabolic antenna 12 associated with a radiofrequency amplifier 14 mounted on the back of the parabolic antenna 12.

The positioner 1 is intended to allow the parabolic antenna 12 to be pointed toward a given satellite, in particular a satellite situated near the vertical of the positioner 1. The positioner 1 is intended to be placed on a moving carrier, which can be of any type. In particular, the positioner 1 is used for civil and/or military applications, and the carrier is a marine, air and/or land carrier. The carrier is for example an aircraft, a land vehicle and/or a ship.

The positioner 1 includes a base 16, which in turn includes a plate 18 and two skates 20, the skates 20 being fixed on the plate 18.

Figure 2:
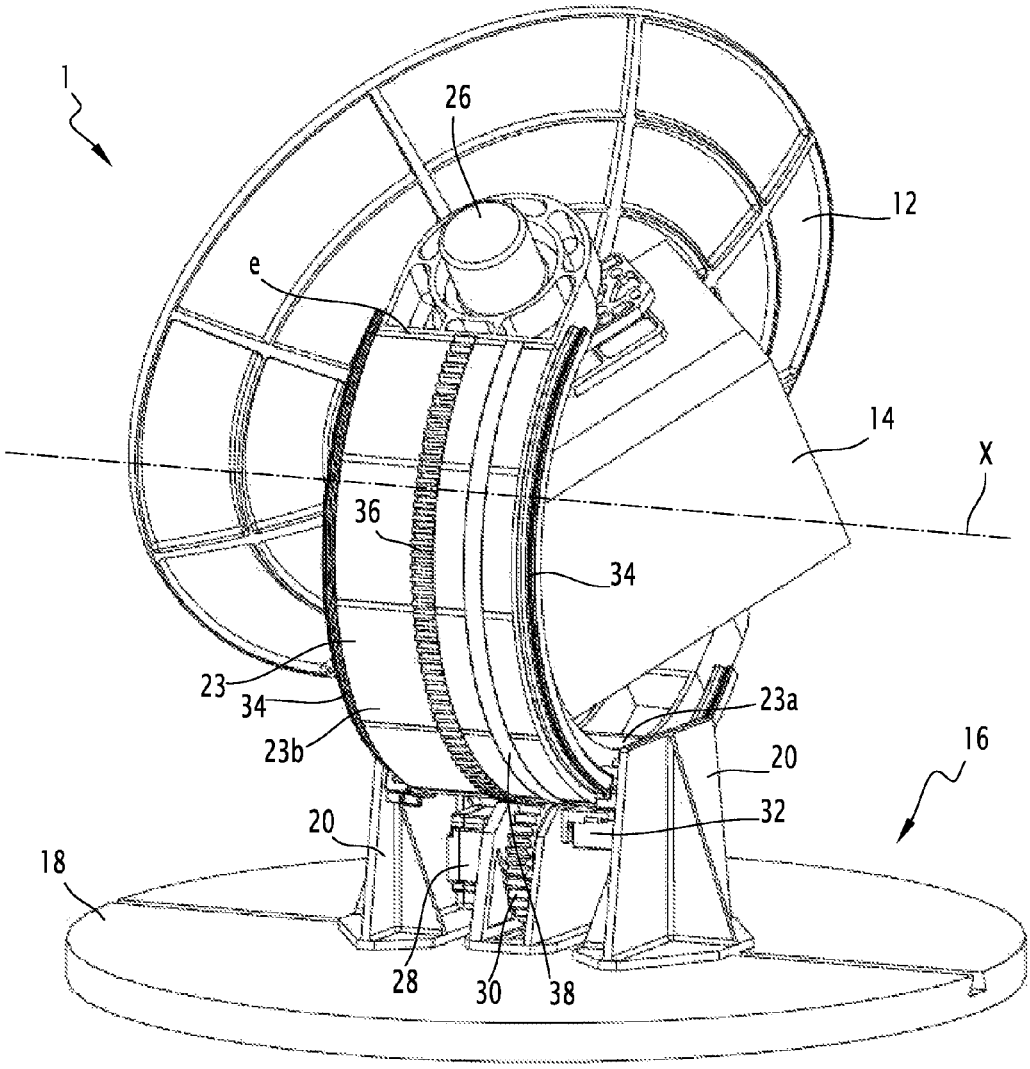
FIG. 2 is another perspective view of the positioner of FIG. 1.

A support cradle 22 including a guide crown 23 is mounted so as to obtain the rotation thereof around the center O of the guide crown 23 and along a first horizontal axis of rotation X while bearing on the skates 20, as shown in FIG. 2. The notion of "horizontal axis" is well known by those skilled in the art, and refers in particular to an axis parallel to the supposed horizontal plane on which the base is placed.

The parabolic antenna 12 and the radiofrequency amplifier 14 constitute a mass able to rotate relative to the cradle 22. To that end, the cradle 22 includes a rotating shaft 24 with axis Y for the parabolic antenna 12 potentially associated with a radiofrequency amplifier 14, as well as actuating and measuring means 26, detailed later in the description, supported by the cradle 22.

The rotating shaft 24, and the actuating and measuring means 26 are such that the parabolic antenna 12 potentially associated with the radiofrequency amplifier 14 is rotated relative to the cradle 22 around the horizontal axis Y, which extends orthogonally to the first horizontal axis of rotation X, while being supported by the cradle 22.

The parabolic antenna 12 extends generally above axis Y, while the radiofrequency amplifier 14 extends in the half-circle delimited by the guide crown 23. Thus, advantageously, the parabolic antenna 12 and the radiofrequency amplifier 14 are arranged on either side of axis Y. They are advantageously distributed so that the center of gravity of the mobile assembly 10 formed in particular from the parabolic antenna 12 and potentially the radiofrequency amplifier 14 is situated on axis Y, irrespective of the angular position of that assembly 10 relative to the crown 23.

The guide crown 23 includes a first portion $P_1$ that has two ends e. The first portion $P_1$ extends along a half-circle centered at a point O and with radius r. The diameter of the half-circle passing through the ends e of the first portion $P_1$ defines a third axis W parallel to the second axis Y and passing through O. Moreover, the second Y and third. W axes are in the plane of the half-circle and the axis X is orthogonal to the plane of the half-circle. The radius r of the half-circle is for example comprised between 10 and 30 cm.

The second Y and third W axes are separated by a non-null distance E, also called spacing E. The spacing E is comprised between 5 and 15 cm.

The second axis Y is balanced by a careful distribution of the masses of the antenna 13 and the radiofrequency amplifier 12.

The first axis of rotation X of the positioner 1 passes through the center O of the half-circle along which the first portion $P_1$ of the guide crown 23 extends, and intersects the third axis W. On the other hand, the second axis of rotation Y of the positioner 1 does not pass through the center O of the half-circle, being parallel to and not combined with the third axis W. In this way, the first X and second V axes of rotation of the positioner 1 do not intersect one another and are separated by a distance equal to the spacing E.

The spacing E is such that the center of gravity of the support cradle 22 and the mobile assembly 10 is situated on axis X. This spacing E makes it possible to balance axis X, by centering the center of gravity of the masses rotating around X on O. Thus, the positioner 1 according to the invention does not have a keyhole at the vertical and promises to be balanced on both of its axes of rotation X and Y.

The positioner 1 also includes an electric motor 28 coupled to a pinion 30, to allow the pinion 30 to rotate. The electric motor 28 and the pinion 30 are fixed on the plate 18 of the base 16 between the skates 20.

Furthermore, an optical reading device 32 is placed under the guide crown 23, between the skates 20. The optical reading device 32 is stationary relative to the guide crown 23.

The guide crown 23 also includes two second portions $P_2$ each extending respectively from the two ends e of the first portion $P_1$, perpendicular to the third axis W.

Each portion $P_2$ of the guide crown 23 includes an orifice to allow the passage of the rotating shaft 24, mounted rotatingly relative to the guide crown 23 along the second axis of rotation Y, and secured thereto through rotational guiding on each portion $P_2$ of the guide crown 23. The rotating shaft 24 forms, in cooperation with the second portions $P_2$ of the guide crown 23, the support means of the parabolic antenna 12. The rotating shaft 24 allows the parabolic antenna 12 to rotate along the second axis of rotation Y. The means 26 for actuating and measuring in rotation around axis Y are arranged on either side of each portion P2.

In the example illustrated in FIGS. 1 and 2, the radiofrequency amplifier 14 and the parabolic antenna 12 are mounted on the rotating shaft 24, the radiofrequency amplifier 14 being situated behind the parabolic antenna 12. In this way, the assembly formed by the radiofrequency amplifier 14 and the parabolic antenna 12 can be rotated around the second axis of rotation Y.

Figure 3:
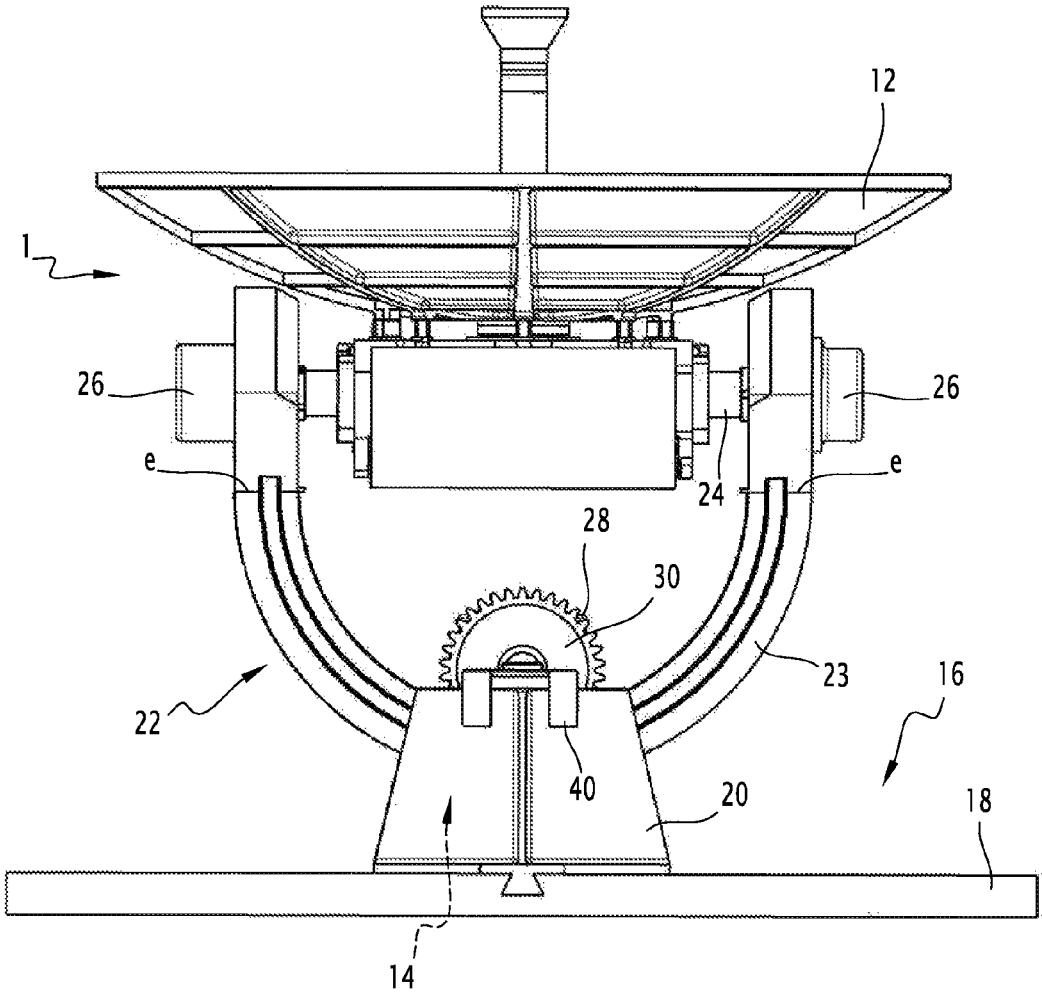
FIG. 3 is an elevation view of a positioner according to the invention equipped with a parabolic antenna, the radiofrequency amplifier being offset.
Figure 4:
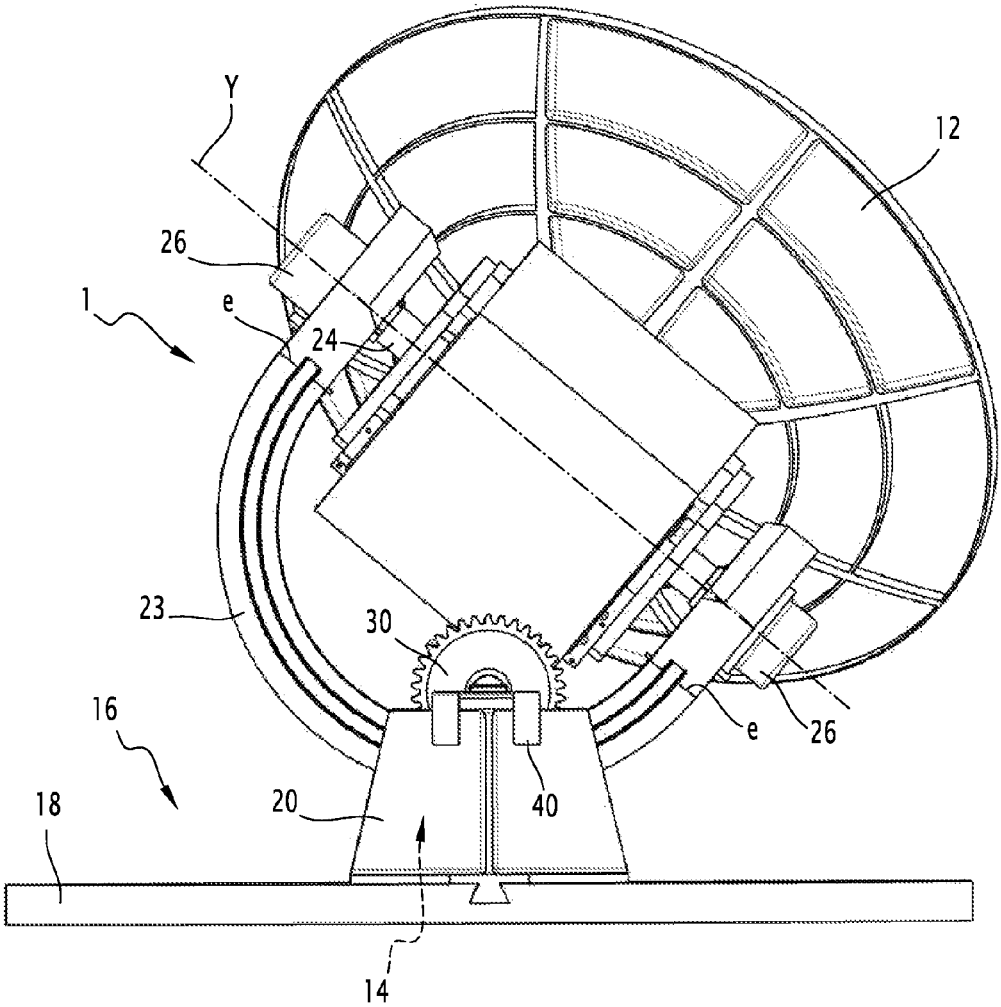
FIG. 4 is another perspective view of the positioner of FIG. 3.

Alternatively, as shown in FIGS. 3 and 4, the radiofrequency amplifier 14 is offset from the rotating shaft 24, so that only the parabolic antenna 12 is mounted on the rotating shaft 24, in that case, the transmission between the radiofrequency amplifier 14 and the parabolic antenna 12 is for example done using flexible coaxial cables and/or flexible waveguides. The motor 28 and the pinion 30 are fixed in this embodiment on the base 16 in the space delimited by the guide crown 23.

The guide crown 23 includes two outer 23*b* and inner 23*a* surfaces, opposite one another. The outer surface 23*b* at the first portion $P_1$, opposite the parabolic antenna 12, includes, on each of its two longitudinal edges, a guide rail 34, intended to allow the guide crown 23 to slide in the skates 20 when the guide crown 23 is rotated around the first axis of rotation X.

Furthermore, the outer surface 23*b* at the first portion $P_1$ includes a toothed crown 36 extending longitudinally on the outer surface 23*b* from one end e of the first portion $P_1$ toward the other end e.

The toothed crown 36 cooperates with the pinion 30 so that when the electric motor 28 makes it possible to rotate the pinion 30, the latter rotates the toothed crown 36, and therefore rotates the guide crown 23 around the first axis of rotation X.

The principle of rotating such a guide crown is for example described in application US 2002/0030631 and U.S. Pat. No. 4,282,529. Alternatively, the guide crown 23 includes two toothed crowns 36, for example being done according to the principle described in application WO 2009/033085.

The outer surface 23*b* of the guide crown 23 also includes, at the first portion $P_1$, a graduated measuring strip (or tape) 38 extending longitudinally over the outer surface 23*b* from one end e of the first portion $P_1$ toward the other end e.

The graduated measuring strip 38 provides information on the angular position of the guide crown 23 during its rotation thereof around the first axis of rotation X. The optical reading device 32 makes it possible to determine this angular position of the guide crown 23 automatically by reading the graduated measuring strip 38. In that way, it is possible to avoid the presence of encoders on the axis of rotation of a guide crown to know its angular position, as taught in the prior art.

In the case where the radiofrequency amplifier 14 is offset, the toothed crown 36 and, if applicable, the graduated measuring strip 38, is for example situated on the inner surface 23*a* of the guide crown 23. The skates 20 include a support 40 making it possible to support the electric motor 28, the pinion 30 and the optical device 32, as shown in FIG. 3. The rotation of the pinion 30 is therefore done on the side of the inner surface 23*a* of the guide crown 23 to rotate the guide crown 23 via the toothed crown 36.

The parabolic antenna 12 has for example a diameter D comprised between 30 cm and 80 cm, for example being equal to 45 cm, 60 cm or 75 cm. In fact, the specific design of the positioner 1 according to the invention allows great configurability in the selection of the diameter of the parabolic antenna 12.

The positioner 1 according to the invention makes it possible to significantly increase the performance for pointing toward the satellite when it is at the vertical of the antenna, for communications in bands X, C, Ku or, preferably, Ka. The positioner 1 according to the invention makes it possible to obtain the necessary precision guaranteeing nominal communication performance for the aforementioned frequency bands.

The total weight of the positioner 1 is reduced, being in particular below 15 kg without the presence of the assembly made up of the parabolic antenna 12 and potentially the radiofrequency amplifier 14. The assembly made up of the parabolic antenna 12 and potentially the radiofrequency amplifier 14 has for example a weight of less than 9 kg.

The geometry particular to the invention of the guide crown 23, the selection of the component material(s) of the guide crown 23 and the choice of the value of the spacing E, associated or not with the position of the radiofrequency amplifier 14 on the rotating shaft 24 behind the parabolic antenna 12, makes it possible to resolve the balance problems of the known XY-type parabolic antenna positioners. The second axis Y being balanced by a careful distribution of the masses of the antenna 12 and potentially the radiofrequency amplifier 14.

During operation, the positioner 1 is made to rotate along the horizontal axes of rotation X and Y, in order to be able to point the parabolic antenna 12 toward the satellite. The rotation along the first axis X is done via the guide crown 23 that slides between the skates 20 following the drive of the pinion 30 by the electric motor 28. The rotation along the second axis Y is done by rotating the shaft 24 that supports the parabolic antenna 12 and potentially the radiofrequency amplifier 14.

The parabolic antenna positioner 1 described above has multiple advantages.

The positioner 1 according to the invention is balanced owing to the non-null spacing between the second Y and third W axes, and the geometry of the guide crown 23. The maintenance of the pointing direction of the parabolic antenna 12 toward the satellite is thus improved under all circumstances, in particular during movement of the carrier. The positioner 1 has a low mass balance that makes it possible to meet all constraints of the environment in which it is situated, in particular aeronautic and/or tactical constraints.

The simplified design of the positioner 1 according to the invention also makes it possible to limit costs and power consumption of the positioner, while allowing significant pointing performance of the positioner and significant travel of the parabolic antenna, for example making it possible to obtain a minimum elevation in the vicinity of 10° to 15°.

The positioner 1 not having an azimuth axis subject to an infinite number of revolutions, as is always the case for Elevation over Azimuth positioners, signal transmission can be done for example using flexible coaxial cables and/or flexible waveguides, in particular in the case where the radiofrequency amplifier is offset, without requiring the use of rotating joints as taught by the prior art, which reduces costs.

Of course, the invention is not limited to the embodiment described above.

Alternatively, the base 16 includes a plate 18 rotating around an additional azimuth axis to make it possible to obtain a positioner 1 along three axes of rotation, the rotating plate for example being made according to the principle described in application CA 1 236 211. The presence of three axes of rotation makes it possible not to have any keyhole in any direction. In a first alternative, the additional azimuth axis is provided with a partial travel (typically +–30 degrees on either side of the axis X of FIG. 2), in which case no rotating joint is necessary, in a second alternative, the additional azimuth axis is provided with a travel n times 360° this time requiring a rotating joint, in which case it is possible to keep the antenna in a stationary position both in terms of direction and orientation, the antenna then being able not to have a rotational symmetry relative to its axis, as for example, if provided with a linear polarization. In a third alternative using either of the two alternatives above, a static rotation of the base (16) around X of about 15 to 45° makes it possible to reach negative elevation shots (see FIGS. 5 and 6).

Also alternatively, the positioner 1 is coupled with the use of a system for catching up backlash to improve the performance for pointing toward the satellite.

Figure 5:
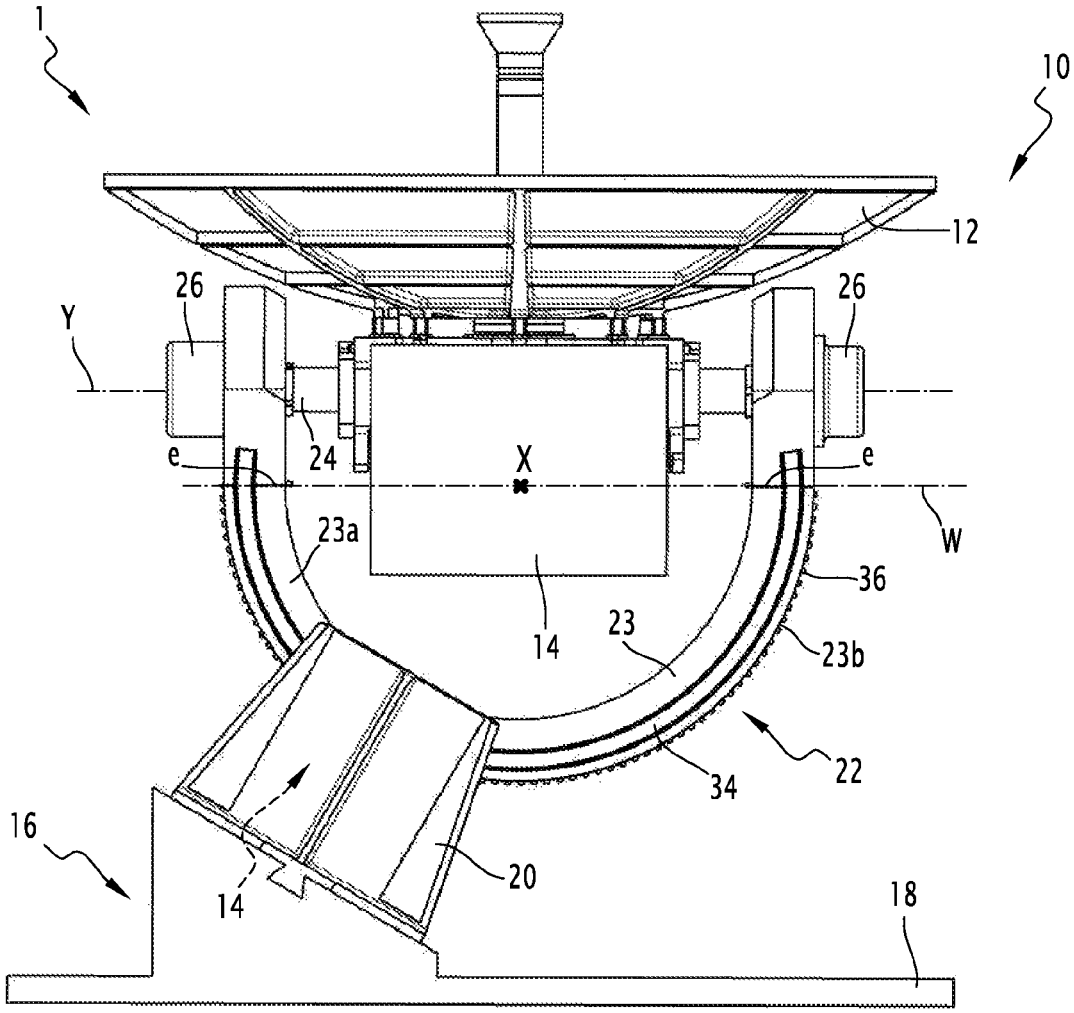
FIGS. 5 and 6 are elevation views of alternative embodiments of the embodiments of FIGS. 1 and 3, respectively.
Figure 6:
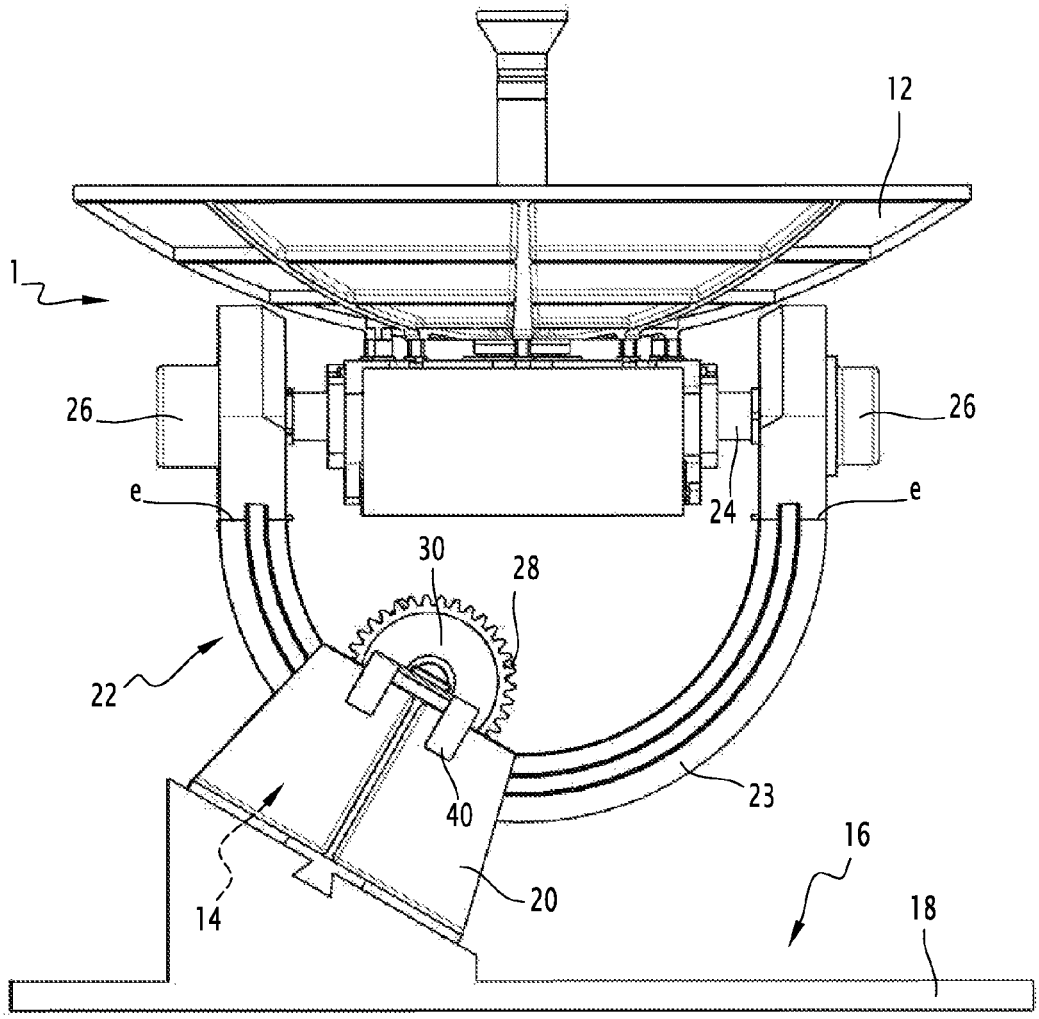

FIGS. 5 and 6 describe alternative embodiments in which the base 16 is angularly offset relative to the guide crown 23 so that when axis Y is horizontal, and parallel to the plate 18, the skates 20 are offset along the crown 23 relative to the projection of the center of gravity of the mobile assembly 10 on the guide crown 23.

The invention claimed is:

1. A parabolic antenna positioner comprising:

a base, a support cradle mounted to rotate relative to the base along a first axis of rotation, a mobile assembly including a parabolic antenna, supported by the support cradle, and mounted to rotate relative to the support cradle along a second axis of rotation, orthogonal to the first axis of rotation, the second axis of rotation being separated from the axis of rotation of the support cradle by a non-null distance measured in the plane of rotation of the cradle, wherein said distance is such that the center of gravity of the support cradle and the mobile assembly is situated on the first axis of rotation.

2. The positioner according to claim 1, wherein the distance separating the second axis and the first axis of rotation of the support cradle is comprised between 5 and 15 cm.

3. The positioner according to claim 1, wherein the support cradle comprises a guide crown having a first portion extending along a half-circle axis and two second portions respectively extending from each of the ends of the first portion of the guide crown, perpendicular to a third axis, the mobile assembly being articulated on the two second portions.

4. The positioner according to claim 3, wherein the guide crown, in particular the first portion of the guide crown, includes a guide rail, in particular two guide rails respectively arranged on each of the two longitudinal edges of one surface of the guide crown.

5. The positioner according to claim 4, wherein the base comprises a skate in which the guide rail slides, in particular two skates in which the two guide rails of the guide crown slide, respectively.

6. The positioner according to claim 4, wherein the guide crown, in particular the first portion of the guide crown, includes a toothed crown extending longitudinally on one surface of the guide crown, in particular from one end of the first portion toward the other end and in that the base includes an electric motor and a pinion, the electric motor rotating the pinion, and the pinion being able to rotate the guide crown by acting on the toothed crown.

7. The positioner according to claim 1, wherein the support cradle includes a graduated measuring strip extending longitudinally on one surface of the cradle, and in that it includes an optical reading device, placed in particular on the base, in order to determine the angular position of the guide cradle by optical reading of the graduated measuring strip.

8. The positioner according to claim 1, wherein the mobile assembly further comprises a radiofrequency amplifier, wherein the parabolic antenna and the radiofrequency amplifier are arranged on either side of the second axis of rotation.

9. The positioner according to claim 1, wherein the support cradle is balanced without balance weights.

* * * * *